US006454626B1

(12) United States Patent
An

(10) Patent No.: US 6,454,626 B1
(45) Date of Patent: Sep. 24, 2002

(54) MOTION EXPRESSIBLE TOY

(75) Inventor: Kyung-Cheol An, Pusan (KR)

(73) Assignee: Jamina Corporation, Pusan (KR)

( * ) Notice: Subject to any disclaimer, the term of this patent is extended or adjusted under 35 U.S.C. 154(b) by 0 days.

(21) Appl. No.: 09/911,726

(22) Filed: Jul. 25, 2001

(30) Foreign Application Priority Data

Nov. 4, 2000 (KR) ..... 2000-030894
May 15, 2001 (WO) ..... PCT/KR01/00777

(51) Int. Cl.[7] ..... A63H 11/00; A63H 13/00; A63H 3/20; A63H 13/02; A63H 3/36

(52) U.S. Cl. ..... 446/330; 446/337; 446/338; 446/352; 446/353; 446/395; 446/391

(58) Field of Search ..... 446/268, 330, 446/337, 338, 352, 353, 395, 391, 372

(56) References Cited

U.S. PATENT DOCUMENTS 3,153,871 A * 10/1964 Semba ..... 446/337
4,504,241 A * 3/1985 Dyson et al. ..... 446/330
4,516,951 A * 5/1985 Saigo et al. ..... 446/330
4,582,499 A * 4/1986 Saigo et al. ..... 446/304
4,799,678 A * 1/1989 Terzian et al. ..... 273/237
5,141,464 A * 8/1992 Stern et al. ..... 446/338
5,902,169 A * 5/1999 Yamakawa ..... 446/337
6,017,261 A * 1/2000 Wachtel ..... 446/338
6,068,536 A * 5/2000 Madland et al. ..... 446/337

FOREIGN PATENT DOCUMENTS

DE 20007096 U1 * 6/2000 ..... A63H/3/28
JP 03258282 A * 11/1991 ..... A63H/13/02

* cited by examiner

*Primary Examiner*—Derris H. Banks
*Assistant Examiner*—Urszula M Cegielnik
(74) *Attorney, Agent, or Firm*—Birch, Stewart, Kolasch & Birch, LLP

(57) ABSTRACT

The present invention is related to a motion expressible toy featuring an animal character, and more particularly to a motion expressible toy which is capable of expressing emotion or intention by taking the various kinds of body gesture characterized by the independent and the combined mechanism of a mouth, a head, arms and a main body as a whole body, and to thereby characterize a real gesture as a really living character such as a gesture of approval, denial or hesitation related to the communication circumstance, to thereby provide familiarity and curiosity to the children.

1 Claim, 5 Drawing Sheets

MOTION EXPRESSIBLE TOY

BACKGROUND OF THE INVENTION

The present invention is related to a motion expressible toy featuring an animal character, and more particularly to a motion expressible toy which is capable of expressing emotion or intention by taking various kinds of body gesture characterized by the independent and the combined mechanism of a mouth, a head, arms and a main body as a whole.

In general, most of toys featuring animal characters are puppies, cats, or bears which can take various motion and make a sound such as walking, jumping, wagging, crying, talking or the likes. The conventional toys have satisfactorily given amusement and pleasure to children as mentioned above motions or sounds.

However, since the conventional toys have been made for a long time without particular variety, the children are fed up with the conventional toys.

Therefore, a new type of toy which features special characteristics or particular function is demanded so that more amusement or pleasure can be furnished to the user of children, and it can provide the curiosity or familiarity to the children.

SUMMARY OF THE INVENTION

In view of the foregoing, it is also an object of the present invention to provide a motion expressible toy which can take a series of motion characterized by the independent and the combined mechanism in connection with the assemblies in the toy, and to thereby characterize a real gesture as a really living character such as a series of motion to extend arms, a head and a body for expressing the various emotion or intension by taking series of motion for the gesture of approval, denial or hesitation related to the communication circumstance, to thereby provide familiarity and curiosity to the children.

It is a further object of the present invention to provide a motion expressible toy which is differentiated from the conventional motion toys and has excellent commodity competitiveness.

BRIEF DESCRIPTION OF THE ACCOMPANYING DRAWINGS

Understanding that these drawings depict only typical embodiments of the invention and are, therefore, not to be considered limiting of its scope, the invention will be described with additional specificity and detail through use of the accompanying drawings in which.

DETAIL DESCRIPTION OF PREFERRED EMBODIMENTS

Figure 1:
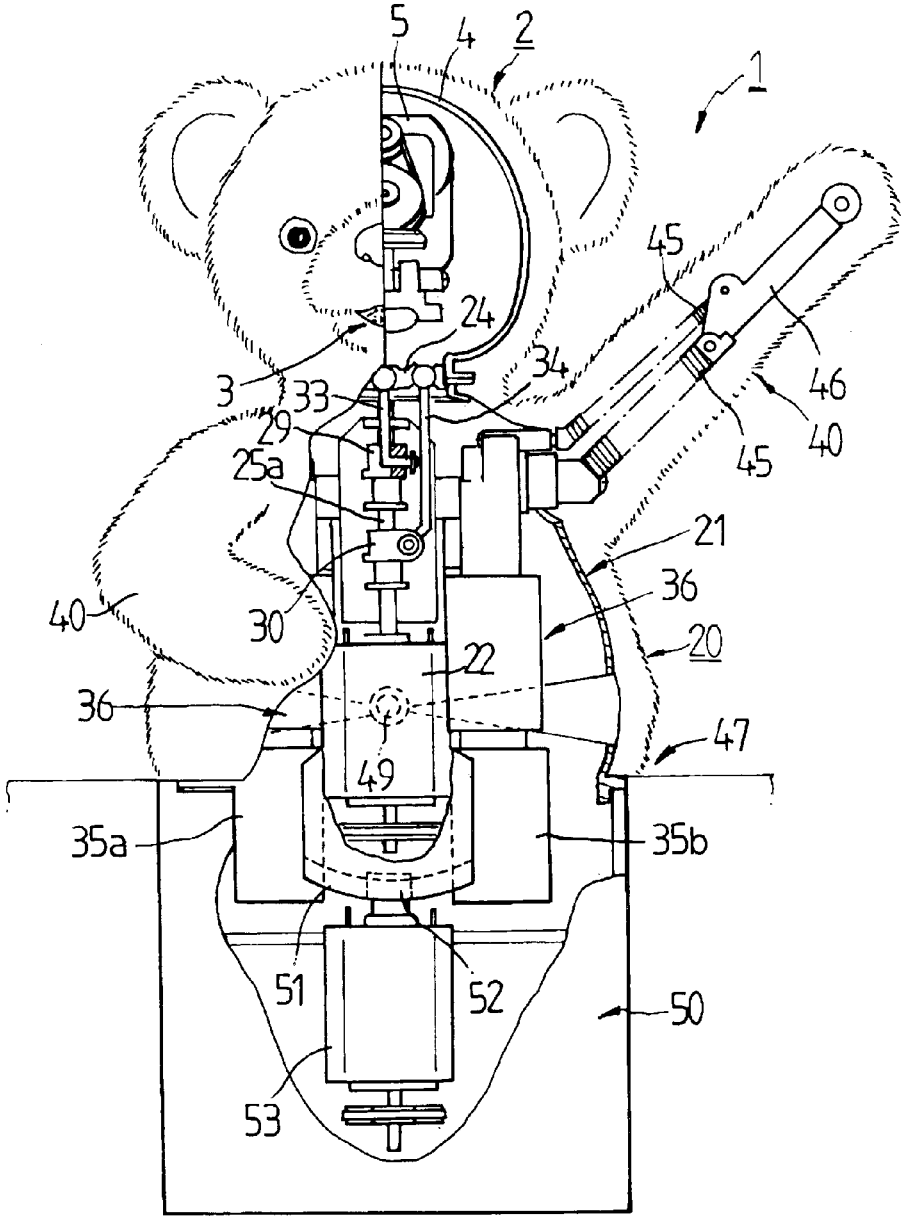
FIG. 1 is a front sectional view of the present invention showing the main embodiment of the motion expressible toy.

The present invention will be described in detail hereinafter with reference to the accompanying drawings, wherein the same reference characters designate corresponding parts throughout several views. It is to be understood that these drawings depict only typical embodiments of the invention and are, therefore, not to be considered limiting of its scope.

Referring now to the drawings, wherein like reference characters designate corresponding parts throughout several views.

Figure 2:
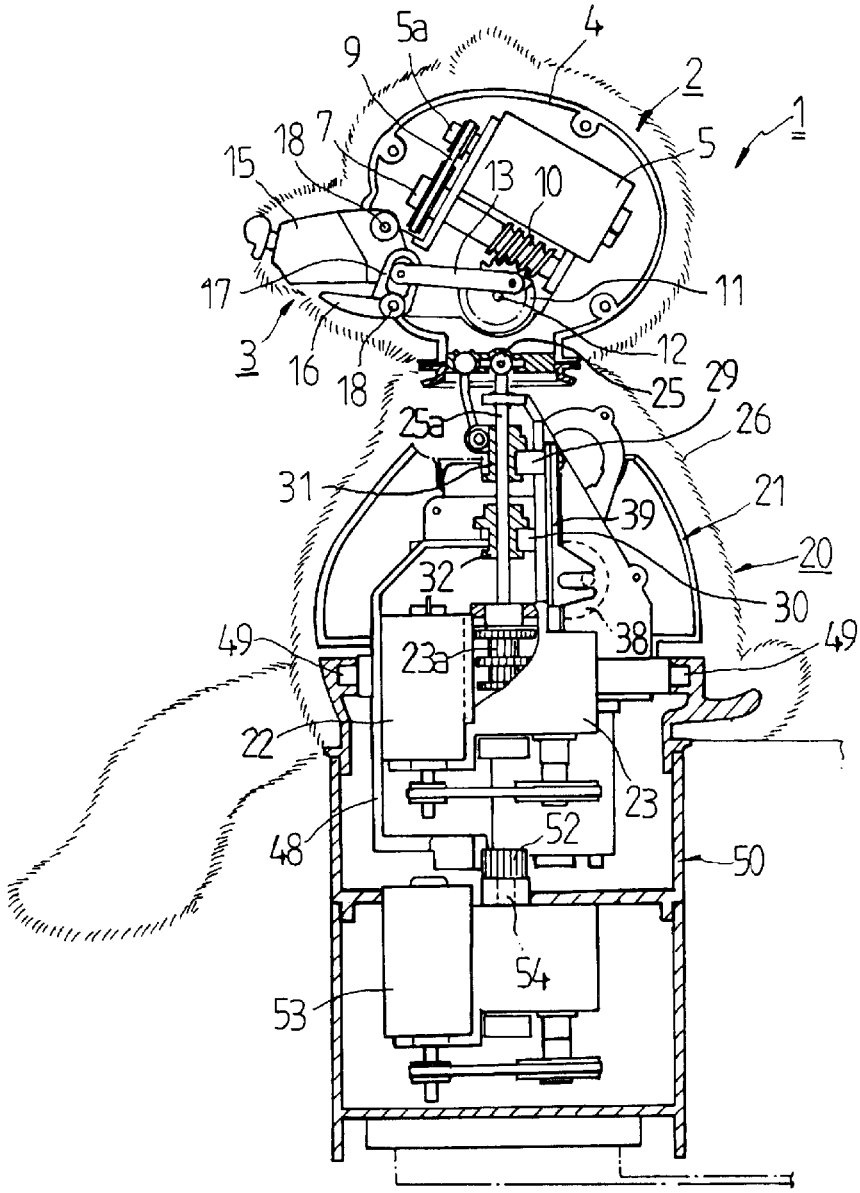
FIG. 2 is a side sectional view of the present invention showing the main embodiment of the motion expressible toy.
Figure 3:
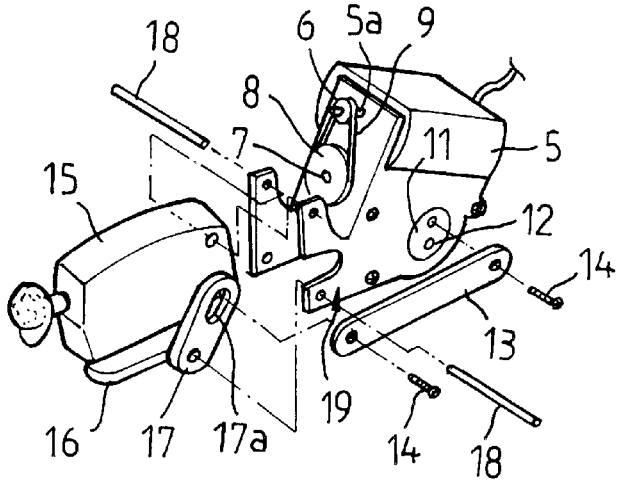
FIG. 3 is a partial perspective view illustrating the head part of the present invention.
Figure 4:
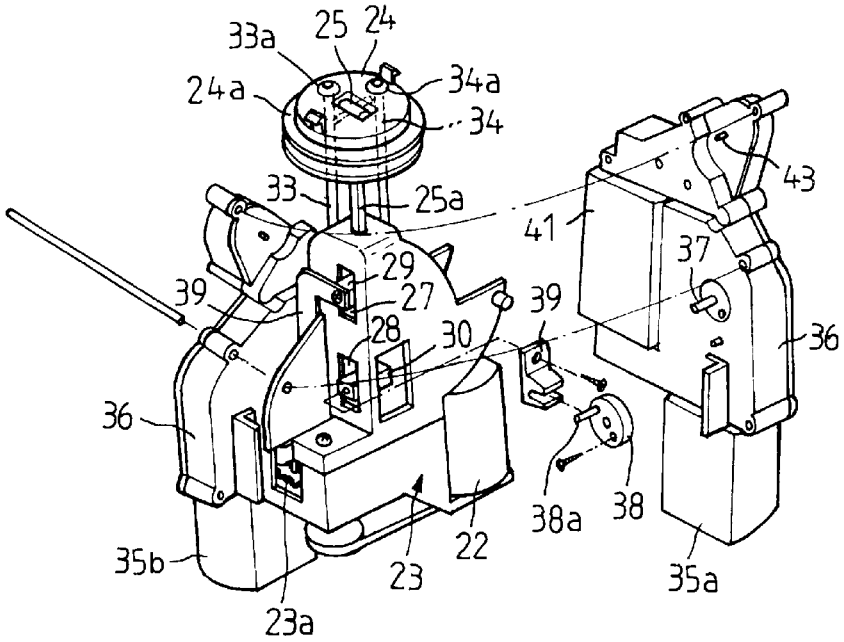
FIG. 4 is a partial perspective view illustrating the main part of the body according to the present invention.
Figure 5:
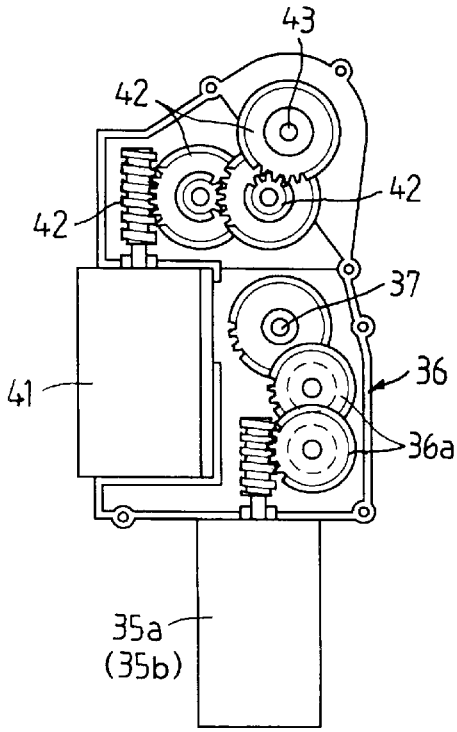
FIG. 5 is a sectional view of the main part of the toy's body illustrating the sliding motor and the reduction gear according to the present invention.
Figure 6:
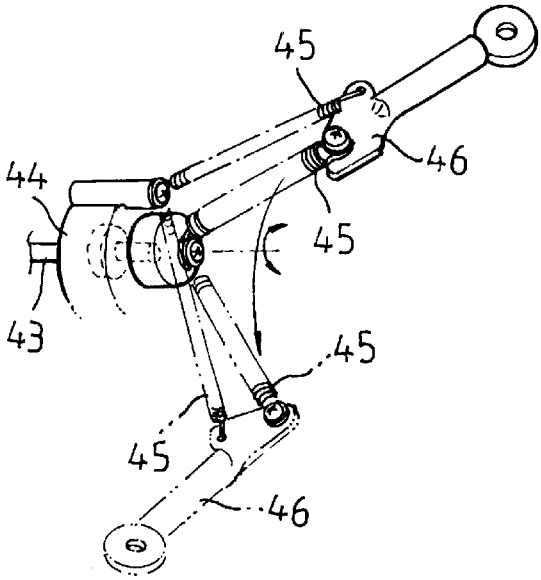
FIG. 6 is a partial perspective view of the arm part according to the present invention.
Figure 7:
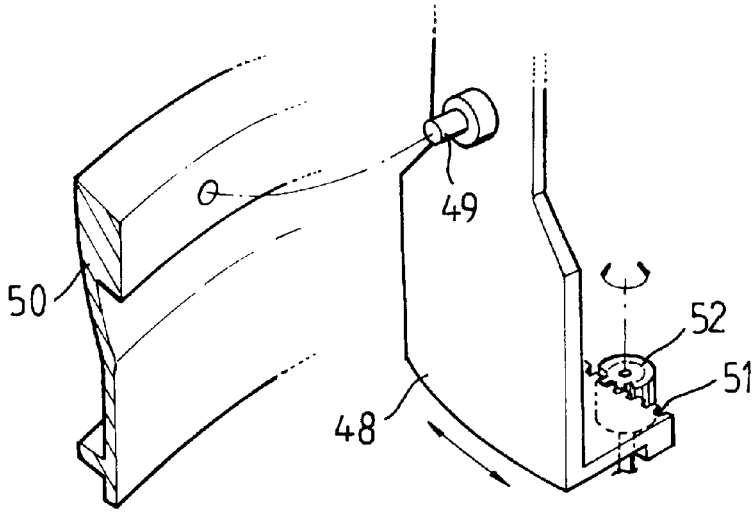
FIGS. 7 is a partial perspective view of the rump part of the main body according to the present invention.

FIG. 1 is a front sectional view of outward appearance of the present invention, FIG. 2 is a side sectional view illustrating components of the present invention, FIG. 3 is a perspective view illustrating the construction of head part according to the present invention, FIG. 4 is a perspective view illustrating the construction of the assembly part of the main body, FIG. 5 is a sectional view of the body part illustrating a sliding motor, a plurality of reduction gears and FIG. 6 is a partial perspective view of an assembly of arm part and FIG. 7 is a partial perspective view of the rump part of the main body according to the present invention.

The reference numeral 1 indicates a toy shaped like a cute bear comprising a head part 2, a main body 20, arms 40 and a lower casing 50. The present invention is characterized in that the independent mechanisms of the assemblies in the toy 1 cooperatively actuate a predetermined motion imitating a body gesture of human being as a really living character to extend arms, head and whole body of the toy 1 expressing the various kind of emotion or intension by taking motions of the gesture implying approval, denial or hesitation so as to provide familiarity and curiosity to the user of children.

The more detail constitution and embodiment related to the predetermined motion will be described hereinbelow with the illustrative examples.

As shown on FIG. 1 and FIG. 2, the whole constitution of motion expressible toy 1 based on the mechanical components can be divided into a head part (2), a main body (20), arms (40) and a lower casing (50).

The detail constitution of head part (2) as shown on FIG. 2 and FIG. 3 is comprising a mouth driving motor (5) installed obliquely at the upper part of the head casing (4), a belt (9) linked between a pulley (6) of a driving axis (5a) and a vertical axis (7), a worm-wheel (11) for the tooth-coupling mechanism with a worm (10) being shaped on the rear part of the vertical axis (7), a link rod (13) for connecting between the worm wheel (11) and a connection link (17), a lower member (16) of a mouth (3) being connected to the bottom part of an upper member (15) by the connection link (17) which has an elongated hole **(17*a*) thereon, an axial installation of a lower member (16) and the upper member (15) by an axial pin (18) installed on the front side parts of a housing bracket (19) (15) being installed so as to operate the pivotal motion thereof, the connection link (17) and the link rod (13) being axially installed through an elongated hole (17*a*) by a pin bolt (14)** are assembled.

According to the structure of the head part (2) in the motion expressible toy (1) as described in the above, the assemblies of the head part (2) is sophisticatedly devised and constructed to take a natural expression of the mouth (3) as a real talking animal.

The rotational force of the mouth driving motor (5) is reduced and transformed into an actuating force for the mouth operating force as a linear alternating motion of the link rod (13) in connection with the lower member (16) and the upper member (15) of the mouth (3). The structure of head part (2) for actuating the mimic operation of the mouth (3) is independently operated in cooperation with the other series of motions which will be described hereinbelow.

The detail operational mechanism related to the motion in connection with nodding, jumping, shaking or rotating of the head part (2) as a whole will be understood with the assembly structure of the main body (20).

According to the constitution of the main body (20) as shown on FIG. 1, FIG. 2 and FIG. 4, the detail structure of the main body (2) is comprising a head rotating motor (22) installed in front of a housing bracket (23) including a plurality of reduction gear (23*a*) therein, a connection piece (24) linked with the head casing (4) of the head part (2) and a driving axis (25*a*) by an universal joint (25) such that the rotating force of the head rotating motor (22) is smoothly transported so as to exert the head frame (4) for the diverse motion of the head part (2). In addition, a cover combining portion (24*a*) rotatable with the connection piece (24) is set to connect a cover (26) which enwraps the outer appearance of the toy (1).

The detail construction for actuating the diverse motion of the head part (2) will be described hereinbelow in connection with the assembly parts in the housing bracket (23).

A plurality of slide guide hole (27, 28) formed on the upper and lower part of the housing bracket (23) is combined with the corresponding a vertical sliding guider (29, 30) so that the vertical sliding guider (29, 30) can slide along the slide guide hole in smooth. The sliding guide (29, 30) connected with a sliding piece (31, 32) as shown on FIG. 2 provide a rotational motion of the head part (2) in the clockwise or anticlockwise direction and a linear alternating motion of the head part (2) in the vertical direction by actuating the sliding piece (31, 32) installed on the axis of a driving axis (25*a*).

The upper sliding piece (31) is connected to the horizontal rotating rod (33) and the lower sliding piece (32) is connected to a vertical sliding rod (34) by the ball joint combination. A corresponding motor (35*a*, 35*b*) for actuating a horizontal rotating rod (33) and a vertical sliding rod (34) are installed in a housing (36) with a plurality of reduction gear (36*a*). The rotational output of the driving axis (37) reduced by the gear combination of the plurality of reduction gear (36*a*) in the housing (36) is transformed into a linear force for actuating the sliding guider (29, 30) by means of a circular cam (38). Specifically, the linear transformation is carried out by the oblique joint between the circular cam (38) attached on a driving axis (37) and a connection lever (39) installed on the sliding guider (29, 30) by the insertion of a connection pin (38*a*). Although the configuration of assembly for the left part of the housing (36) is not shown in detail, one can easily understand the symmetry structure which can be identically constructed in the opposite position having a symmetrical shape except the connection lever (39).

For the smooth and the natural motion of gesture regarding the head part (2), the right part of the connection lever (39) combined with the upper sliding guider (29) is shaped little longer than the longitudinal length of the left part of connection lever (39).

The combinational or separate operation of the rotating motion and the linear alternating motion in connection to the above mentioned structure of the main body (2) results a motion of nodding, jumping, shaking or rotating of the head part (2) as a whole.

Besides, a couple of arm (40) attached on the right and the left part of the main body (20) with the assembly part of an arm driving motor (41) installed on the upper part of the housing (36) and a plurality of reduction gear (42) in the housing (36) is constructed such that the swing motion of an arm around the belly part of the main body (20) can be smoothly achieved as shown on FIG. 5.

The rotational output of a driving axis (43) reduced by the gear coupling of a plurality of reduction gear (42) in the housing (36) is transformed into a linear exerting force for actuating a swing arm (45) and a fixing arm (46) by means of a circular cam (44).

Specifically, the exertion force for lifting or bending the arm (40) is carried out by the oblique joint between the circular cam (44) axially installed on the driving axis (43) and the swing arm (45) connected with the fixing arm (46) by the pivotal conjunction.

Another of arm (40) having a symmetrical configuration although not shown on FIG. 6 is identically constructed at the opposite side.

For enhancing the smooth operation or preventing the breakage of the arm (40) by grabbing or mishandling of the user, the swing arm (40) is desirous that a resilient or flexible material such as a spring substance is used for the material of the swing arm (40).

According to the additional embodiment of the present invention, the toy (1) under the present invention is devised to activate a see-saw motion within a predetermined angle in the respect of the center of the main body (20).

The detail constitution and structure in connection to the see-saw motion are followings.

An inner casing (48) including a housing bracket (23) and the housing (36) as a whole is set in a lower casing (50) which is shaped as a form of chair for the main body (2) of toy (1). Using an axial pin (49) formed on the center of the inner casing (48). the inner casing is combined with the lower housing (50). A rack gear (51) having an arc shaped on the lower part of the inner casing (48) is set to couple with a pinion gear (52) which is shaped around the end part of a driving axis (54) of a motor (53) so that the see-saw motion of the whole body along the contact line of the rump (47) is achieved in accordance with the rotation of the pinion (52) combined with the motor (52) therein.

In addition to the above mentioned structure and constitution, all kinds of motor installed in the actuating toy (1) under the present invention are set to be control with the separate controllers for the more delicate and smooth gestures. Furthermore, the motion controls related to the position and velocity are carried out by applying the various sensors such as variable registers, digital sensors, optical or switching sensors at the edge of the output for detecting the phase angle in connection with the gesture of motion.

As shown on the above mentioned description, the motion expressible toy under the present invention is devised so as to provide the practical amusement or the educational means by actuating various kinds of gesture based on the independent or combined mechanism of the assembly such as a mouth, a head, arms and a main body as a whole.

The motion expressible toy having various gestures as a real creature provides more curiosity, novelty and familiarity to the children comparing the motion toy in the prior art. Moreover the present invention can be sophisticatedly utilized for the purpose of the educational means to the children.

Those skilled in the art will readily recognize that these and other modifications and changes may be made to the present invention without strictly following the exemplary application illustrated and described herein, and without departing from the true spirit and scope of the present invention, which is set forth in the following claims.

What is claimed is:

1. The motion expressible toy comprising, a head part (2);

the head part (2) further comprising a mouth driving motor (5) installed obliquely at the upper part of a head casing (4), a belt (9) linked between a pulley (6) of a driving axis (5*a*) and a vertical axis (7), a worm-wheel (11) for the tooth-coupling operation with a worm (10) shaped on the rear part of the vertical axis (7), a link rod (13) being connected between the worm-wheel (11) and a connection link (17), a lower member (16) of a mouth (3) being connected to the bottom part of an upper member (15) by the connection link (17) having an elongated hole (17*a*) therein, a main body (20);

the main body (20) further comprising a head rotating motor (22) installed in front of a housing bracket (23) including a plurality of the reduction gear (23*a*), a connection piece (24) linked with the head casing (4) of the head (2) and a driving axis (25*a*) by the universal joint (25), a cover combining portion (24*a*) rotatable with the connection piece (24) being set to connect a cover (26) enwrapping the outer appearance of the toy (1), a plurality of the sliding guide hole (27, 28) formed on the upper and lower part of the housing bracket (23) being combined with the corresponding vertical sliding guider (29, 30), a plurality of sliding guide (29, 30) connected with the sliding piece (31, 32) being installed on the axis of the driving axis (25*a*), the upper sliding piece (31) being connected to the horizontal rotating rod (33), the lower sliding piece (32) being connected to the vertical sliding rod (34) by the ball joint combination, a plurality of driving motor (35*a,* 35*b*) for actuating a horizontal rotating rod (33) and a vertical sliding rod (34) being installed in the housing (36) with a plurality of reduction gear (36*a*), a driving motor (41) for actuating a swing arm (45) and a fixing arm (46), being installed in the housing (36) with a plurality of reduction gear (42), a circular cam (38) attached on the driving axis (37) and the connection lever (39) installed on the sliding guider (29, 30) by the insertion of the connection pin (38*a*) therein, a couple of arm (40);

the arm further comprising a circular cam (44) axially installed on a driving axis (43) and a swing arm (45) connected with a fixing arm (46) by the pivotal conjunction therein, a lower casing (50);

the lower casing (50) further comprising an inner casing (48) including an axial pin (49) formed on the center of a inner casing (48), a rack gear (51) having an arc shaped and located on the lower part of inner casing (48) being set to couple with a pinion gear (52) being shaped around the end part of the driving axis (54) of the motor (53) therein;

so that the various gesture in connection with the motion of a mouth, a head, arms and a main body as a whole are made to be independently or simultaneously executed.

* * * * *